US006676357B2

(12) United States Patent
Stafford et al.

(10) Patent No.: US 6,676,357 B2
(45) Date of Patent: Jan. 13, 2004

(54) ARCUATE BULK STORAGE FACILITY

(75) Inventors: Brian T. Stafford, Selby (CA); John B. Elder, Belleville (CA)

(73) Assignee: EMS-Tech, Inc., Belleville (CA)

( * ) Notice: Subject to any disclaimer, the term of this patent is extended or adjusted under 35 U.S.C. 154(b) by 177 days.

(21) Appl. No.: 10/015,792

(22) Filed: Dec. 17, 2001

(65) Prior Publication Data

US 2003/0113194 A1 Jun. 19, 2003

(51) Int. Cl.[7] ..... B65G 3/04

(52) U.S. Cl. ..... 414/306; 198/508; 414/300; 414/325

(58) Field of Search ..... 414/299, 300, 414/305, 306, 325, 327; 198/369.5, 508; 52/192, 197

(56) References Cited

U.S. PATENT DOCUMENTS

| | | | | |
|---|---|---|---|---|
| 501,771 A | * | 7/1893 | Dodge | 414/293 |
| 1,981,417 A | * | 11/1934 | Kreutzer | 119/449 |
| 1,996,488 A | * | 4/1935 | Philips | 198/508 |
| 3,838,780 A | * | 10/1974 | Ridlehuber | 414/327 |
| 4,164,294 A | * | 8/1979 | Johnson | 414/808 |
| RE32,536 E | * | 11/1987 | Wolstenholme | 99/646 S |

FOREIGN PATENT DOCUMENTS

DE 3624390 A1 * 1/1988

* cited by examiner

*Primary Examiner*—James W. Keenan
(74) *Attorney, Agent, or Firm*—Robert A. Wilkes; Shapiro Cohen

(57) ABSTRACT

An arcuate structure for bulk particulate solids which has inner and outer concentric containment walls. The space between the inner and outer walls is subdivided into a plurality of storage subspaces, and covered with a continuous roof. A radial stacker conveyor system receives particulate solids to be stored, and transfers these particulate solids into a selected storage space through access apertures disposed on a circular arc in the roof. To allow the radial stacker to access each roof aperture, it is rotatable about an axis concentric with the inner and outer walls, and the roof apertures are located on an arc concentric with the inner and outer walls. A separate radially located conveyor system is provided beneath the floor of each storage space, by means of which particulate solid stored in any chosen storage subspace can be retrieved through discharge gates located in the floor of each storage space above the conveyor, and transported to a delivery system adjacent to the radial stacker. The length of arc used for the structure is largely determined by the available space, and the chosen delivery system. Typically the arc length will be about 180°, and can be 360°. Since the storage spaces and the conveyor systems can all be enclosed, localized pollution is minimized. Further, since all of the storage spaces are protected by a roof, the effects of weather on the stored particulate materials is substantially eliminated.

9 Claims, 3 Drawing Sheets

ARCUATE BULK STORAGE FACILITY

FIELD OF INVENTION

This invention relates to a bulk storage facility for the storage of particulate solids which are transported in bulk as an essentially dry powder. This invention is more particularly concerned with a bulk storage facility which is used in combination with one or more conveyor belt systems or the like both to transfer a particulate solid into the facility, and to retrieve a particulate solid from the storage space, or spaces, within the facility.

The name "CIRC-A-BIN© STORAGE FACILITY" will be used for marketing purposes.

Many materials are shipped in bulk as a particulate solid; typical examples are all types of grain, wood chips, coal, alumina and other minerals, sulphur, fertilizers, cement, sand, gravel and crushed stone. These particulate materials range in size from wheat, which is relatively small and has a relatively low bulk density, to minerals, coal and crushed stone which can include particles with a maximum dimension of up to about 20 cm, and which have a considerably higher bulk density. In transporting such materials in bulk, it is commonplace to use more than one form of transport, typically including bulk carrier ships, barges, rail hopper cars and road trucks. These bulk materials are often stored for variable periods of time, particularly when transfer is required to and/or from one form of transport, such as a railcar, to another, such as a bulk carrier ship. In some cases, various types of covered hopper are used for storage, particularly for particulate solids such as grain which need to be protected from weather damage. The particulate solid is usually delivered to the hopper by an overhead conveyor of some sort, ranging from a more or less continuous feed from a conveyor belt, to a crane operated bucket loader. The particulate solid is usually retrieved from the hopper through at least one bottom opening in the hopper, which is closed by at least one discharge gate or basket gate.

In the past, solids such as coal, sundry minerals, sulphur and crushed stone which are more or less resistant to weather damage have been stored in the open in simple heaps, without any protection. This practise is becoming more and more less acceptable for a variety of reasons. First, a particulate solid material can only be readily handled by conveyor systems when it is free flowing: storage in the open can result in a wet material which does not flow readily. Second, when handled in a reasonably dry state many of these solids present pollution problems, ranging from the consequences of associated dust, for example, coal dust which will coat any more or less horizontal surface, to the dispersion of potentially toxic air borne dusts into the local environment from many metal ores. Third, when some of these materials are exposed to weathering, potentially toxic contaminants can be leached out of the solids and transferred into the local groundwater.

It can thus be seen that there is a need for a storage facility which can be used as a storage space for materials which are transported in bulk which allows for both storage and retrieval of the material, protects the material from the effects of the weather, and also substantially protects the local environment from pollution derived from, or associated with, the presence of the stored solids. Advantageously, the storage facility should be capable of providing separated storage spaces within which differing products are storable without contamination from other products held in the facility. Additionally, the storage facility should be capable of receiving one product into at least one storage space at the same time as another product is being retrieved from at least one other storage space within the facility.

This invention seeks to provide such a storage facility. In the storage facility of this intention, an arcuate structure is provided which has inner and outer concentric containment walls. The space between the inner and outer walls is subdivided into a plurality of radial storage subspaces, and covered with a continuous roof. A radial stacker conveyor system is provided which receives particulate solids to be stored, and transfers these particulate solids into a selected storage subspace through access apertures disposed on a circular arc in the roof. To allow the radial stacker to access each roof aperture, it is rotatable about an axis concentric with the inner and outer walls, and the roof apertures are located on an arc concentric with the inner and outer walls. A separate radially located conveyor system is provided beneath the floor of each storage subspace, by means of which particulate solid stored in any chosen storage subspace can be retrieved through suitable discharge gates located in the floor of each storage space above the conveyor, and transported to a delivery system adjacent to the radial stacker. The length of arc used for the structure is largely determined by the available space, and the chosen delivery system. Typically the arc length will be about 180°, and can be 360°. It can thus be seen that in the arcuate storage facility of this invention particulate solid flows into the storage spaces from the center of the arc, and flows out of the storage subspaces back to the same point. Since the storage subspaces and the conveyor systems can all be enclosed, localised pollution is minimised. Further, since the storage space is protected by a roof, the effects of weather on the stored particulate materials is substantially eliminated.

Thus in a first broad embodiment this invention seeks to provide an arcuate storage facility for a particulate material including in combination:

- an arcuate structure having substantially radial end containment walls, inner and outer concentric arcuate containment walls and a floor which in combination define a storage space;
- a continuous roof covering the space defined by the end, inner and outer containment walls;
- a plurality of access aperture structures in the continuous roof disposed on a circular arc concentric with the inner and outer walls, each of which aperture structures includes a closure means;
- a first control means to selectively open and close the access apertures;
- a radial stacker means, rotatable about a vertical axis substantially concentric with the inner and outer walls, constructed and arranged to receive a first flow of particulate solids and to transfer the received flow of particulate solids into the facility through a selected aperture in the roof to a first location in the storage space;
- a plurality of groups of discharge openings located in the floor, each discharge opening being provided with a discharge gate, and each group of discharge openings being located on a line radial to the inner and outer walls;
- a second control means to selectively open and close the discharge gates; and
- a plurality of radial conveyor means located beneath the floor, each radial conveyor means being constructed and arranged to receive a second flow of particulate solids from a second selected location within the storage space through at least one open discharge gate, and to transport the received second flow to a location adjacent the axis of the radial stacker, and each conveyor means being located on the same radial line as the group of discharge gates from which it can receive the second flow.

Preferably, the storage space includes internal containment walls providing a plurality of separate subspaces, each subspace including at least one roof access aperture and at least one floor discharge gate. More preferably, the internal containment walls are located radially relative to the inner and outer arcuate walls. Alternatively, the internal walls are arcuate and concentric with the inner and outer walls.

Preferably, the radial stacker means includes a belt conveyor system supported by a support tower and by the inner arcuate wall.

Preferably, the arc length of the arcuate structure is at least about 180°.

The invention will now be described with reference to the following drawings in which.

Figure 1:
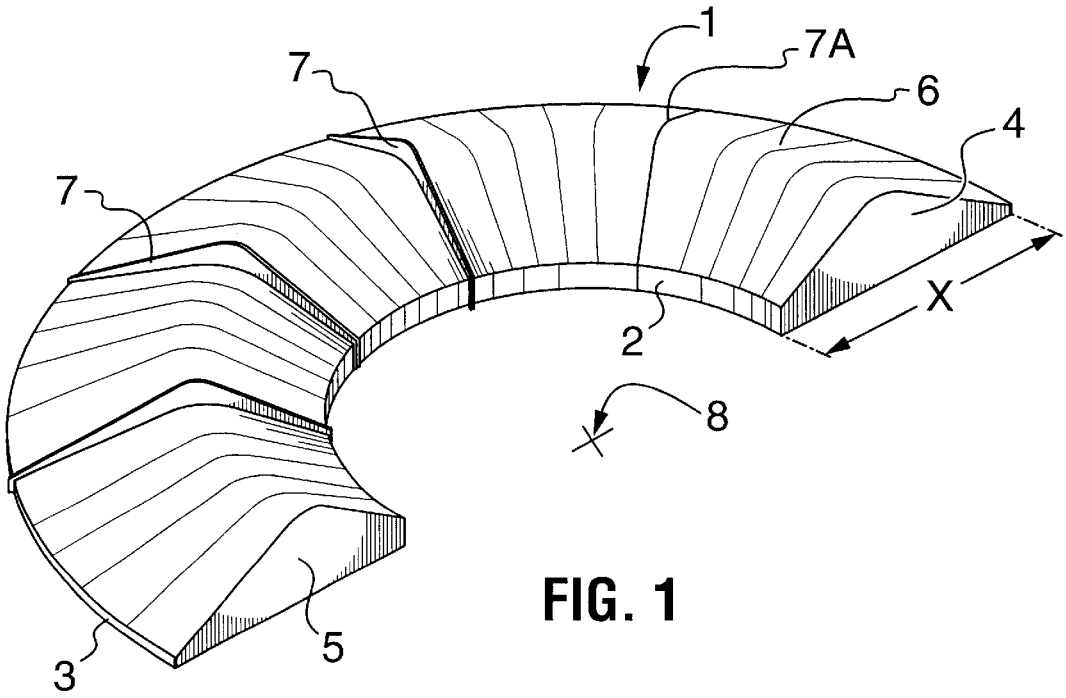
FIG. 1 shows a schematic view of the arcuate structure.

Referring first to FIG. 1, only the arcuate structure is shown for clarity. In FIG. 1, the arcuate structure 1 has an inner arcuate containment wall 2, an outer arcuate containment wall 3, and radial end containment walls 4 and 5. The four walls 2, 3, 4 and 5 define a storage space. The storage space is covered by the roof 6, which is supported by the walls 2, 3, 4 and 5. The roof is also supported by the internal containment walls 7 which project through the roof and thus also serve to support it; these walls need not project through the roof in order to provide support. As shown the walls 7 are located radially. Alternatively, as indicated at 7A, the roof can extend from the inner wall 2 to the outer wall 3 unsupported by radial walls. The inner and outer walls are arcs of concentric circles with a common centre at the point 8; the walls 7 are also located radially from this common centre point.

The heights of the inner wall 2 and the outer wall 3 could differ due to the requirement for space inside the arc of the inner wall 2 for the devices used to transfer particulate solids into, and out of, the arcuate structure 1. The radial distance X between the inner and outer walls 2, 3 is chosen to suit the repose angle of the particulate materials to be stored.

Figure 2:
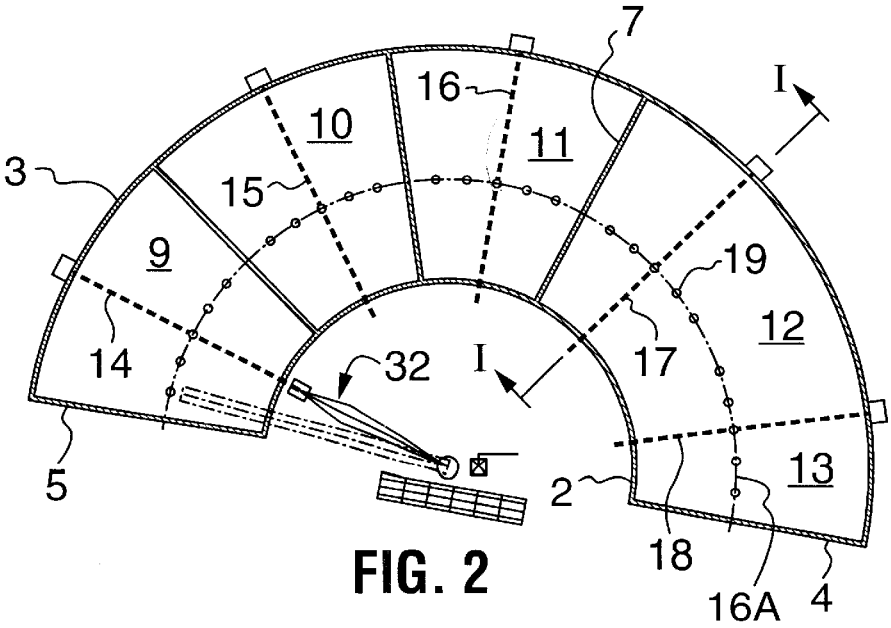
FIG. 2 shows a partly sectioned plan view of FIG. 1.

The partly sectioned plan in FIG. 2 shows the internal arrangement of the arcuate structure of FIG. 1. The radial internal containment walls 7 define a plurality of subspaces 9, 10, 11 and 12, which as shown are not all of the same size: the subspace 12 is approximately twice the size of the others. The storage space can also be subdivided using arcuate concentric containing walls (see the discussion of FIG. 4, below).

Beneath the floor 13 a series of radial conveyors 14, 15, 16, 17 and 18 are located. The conveyors 14, 15, and 16 are located beneath subspaces 9, 10 and 11 respectively; the conveyors 17 and 18 are both located beneath the subspace 12. The location of the conveyors, and the number to be provided, are both determined by the number of subspaces and their arrangement within the arcuate structure 1.

Figure 3:
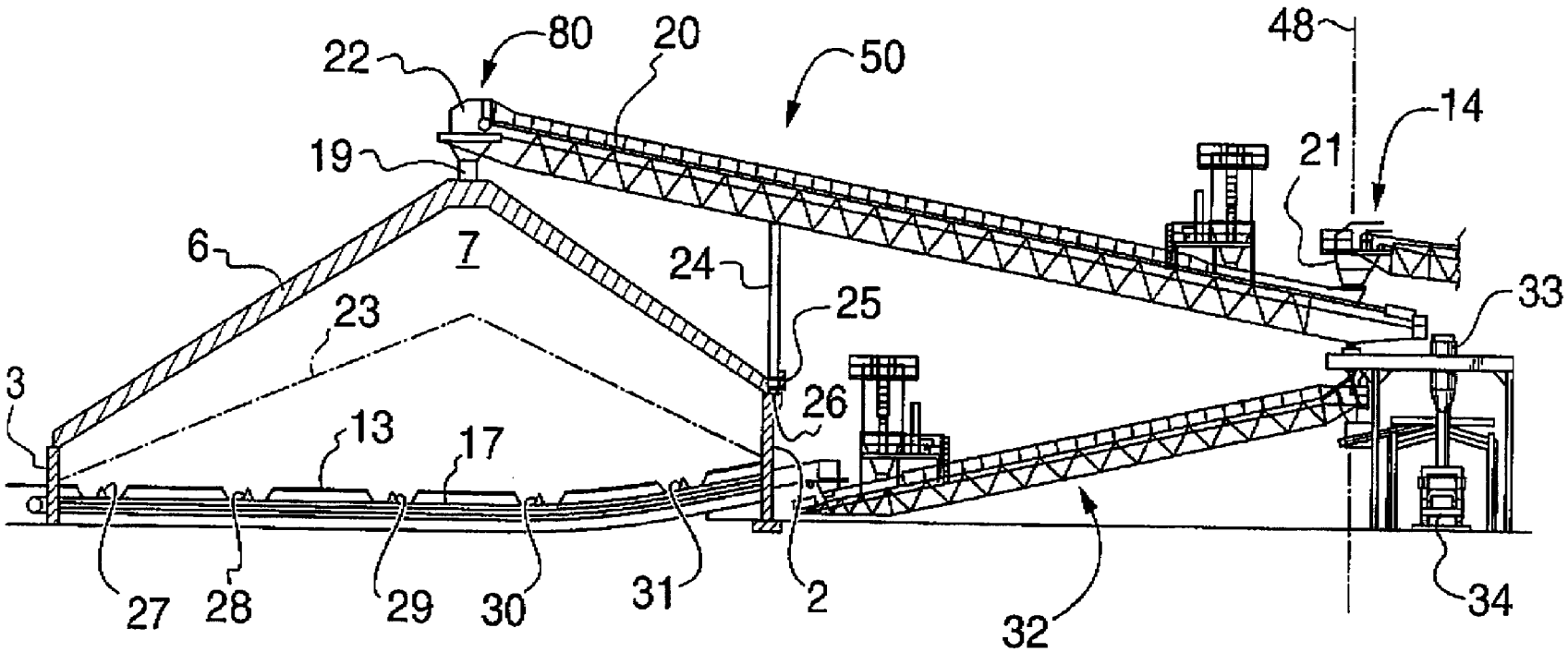
FIG. 3 shows a cross section on the line AA of FIG. 2.
Figure 4:
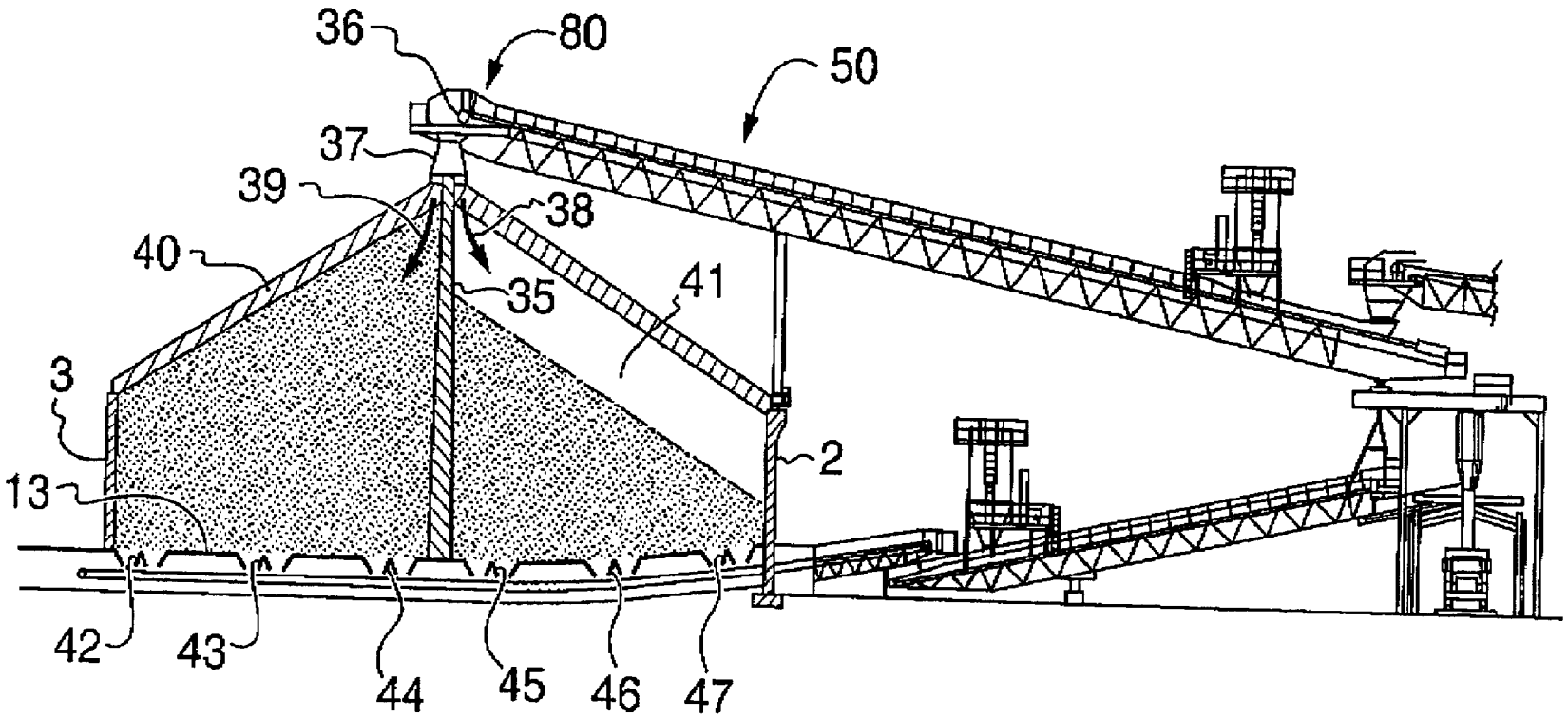
FIG. 4 shows an alternative construction to that shown in FIG. 3.

In the schematic cross sections of FIGS. 3 and 4 the details omitted from FIGS. 1 and 2 are shown. Both of FIGS. 3 and 4 are essentially a cross section taken on the line A—A of FIG. 2, that is in the direction of the conveyor 15. Both the construction and operation of the storage facility will be described with reference mainly to FIG. 3.

Referring first to FIG. 3, the storage space is bounded by the inner containment wall 2, the outer containment wall 3, a radial wall 7, the roof 6, and the floor 13. Beneath the floor 13 is located a belt conveyor 17.

When particulate material is being stored, a first flow of particulate material is received from the conveyor system 14 (only the end of which is shown) by the radial stacker 50. The radial stacker 50 is moveable through an arc 16A (see FIG. 2) about its axis 48, which is located at, or close to, the common center point 8. The outer end 80 of the radial stacker 50 thereby can be positioned over each of the roof access aperture structure 19 (see also FIG. 2). Each roof access aperture structure 19 includes a closure means, such as cooperating shutters, which are remotely controlled. Devices of this type, and the control means required for them, are both well known.

The first flow of particulate material is moved along the radial stacker 50 by a conveyor belt system 20 which receives the first flow from the conveyor 14 through a conventional spout assembly 21. The conveyor 20 delivers the first flow through another conventional spout assembly 22 at the end 18 of the radial stacker 50 into the storage space, through the access structure 19, which will have been opened. The particulate solids then accumulate in the space bounded by the floor 13, and the containment walls 2, 3 and 7 at a repose angle indicated by the chain line 23. When a section of the storage space becomes filled, or when a different particulate material is to be stored, the radial stacker is moved to a new preselected location, and the access structure in use is closed and the required one opened.

In order to support the length of to radial stacker 50 adequately, it is provided wit a suitably located support strut 24. The support strut 24 includes a wheeled carriage 25 which runs on a suitable track 26 on tap of the wall 2. Conveniently, the wheeled carriage can be powered to move the radial stacker along the track 26.

The floor 13 is provided with a series of discharge gates 27, 28, 28, 30 and 31. When a second flow of particulate material is recovered from the storage space, the discharge gates will generally be opened sequentially to provide a desired rate of flow from the storage space onto the conveyor 17. Both the discharge gates used, and the required remote control systems for them, are well known. It is preferred to use hydraulically controlled basket gates for this function. As can be seen in FIG. 3, the floor 13 is also shaped to facilitate the second flow from the storage space.

As shown in FIG. 3, the conveyor 17 delivers the second flow to a radial conveyor shown generally at 32 (see also FIG. 2). The radial loadout conveyor 32 as shown delivers the second flow to a loading spout 33, and thence to a road truck 34. Other arrangements can be used to transfer the second flow elsewhere, for example to a railway hopper car, or to the holds of a bulk carrier ship. Further, the second radial conveyor can be arranged to deliver the second flow to an underground conveyor rather than the overhead one shown.

The radial conveyor 32 can also be rotated about the same axis 48 as to first radial stacker 50, thereby enabling it to receive the flow from any of the radial conveyors 14–19 as required.

FIG. 4 differs from FIG. 3 in two respects: to storage space is differently subdivided, and both the access structure 19 and the spout 22 are differently constructed. The storage space includes an arcuate containment wall 35, which is concentric with the inner and outer containment walls 2, 3.

The wall 35 is thus directly 70 beneath the arc through which the head 80 of the radial stacker 50 moves. The spout 36 and the access structure 37 are modified so tat the first flow can be directed to either side of the wall 35, as shown by the arrows 38 and 39. The conveyor 17 will ten receive the second for from either the subspace 40 or the subspace 41, depending upon which of the discharge gates 42–47 are opened.

The length of the arc used for the arcuate structure 1 is largely determined by the space available for the building, which will usually be of considerable size. For example, a structure with a 180° arc designed to store 60,000 short tons (2,500,000 cubic feet) of grain will have a floor area of about 75,000 square feet and an outer wall radius of about 250 feet.

The manner in which the storage space is subdivided into subspaces will generally depend on the products to be stored. If only one product, for example wheat, is to be stored then subdivision may not be required. If several products, or several different shipments of the same product, are to be stored then subdivision is desirable. The most convenient internal containment wall arrangement is to locate them radially so that in addition to providing a series of subspaces, the dividing walls also contribute to inner and outer wall stability and assist in supporting the roof. As shown above, internal arcuate containment walls can also be used, for example to further subdivide a subspace between two radial internal containment walls.

What is claimed is:

1. An arcuate storage facility for a particulate material including in combination:

an arcuate structure having substantially radial end containment walls, inner and outer concentric arcuate containment walls and a floor which in combination define a storage space;

a continuous roof covering the space defined by the end, inner and outer containment walls;

a plurality air access aperture architectures in the continuous roof disposed on a circular arc concentric with the inner and outer walls, each of which aperture structures includes a closure means;

a first control means to selectively open and close the access apertures;

a radial stacker means, rotatable about a vertical aids substantially concentric with the inner and outer walls, constructed and arranged to receive a first flow of particulate solids and to transfer the received flow of particulate solids into the facility through a selected access aperture in the roof to a first location in the storage space;

a plurality of groups of discharge openings located in the floor, each discharge opening being provided with a discharge gate, and each group of discharge openings being located on a line radial to the inner and outer walls;

a second control means to selectively open and close the discharge gates; and a plurality of radial conveyor means located beneath the floor, each radial conveyor means being constructed and arranged to receive a second flow of particulate solids from a second selected location within the storage space through at least one open discharge gate, and to transport the received second flow to a location adjacent the axis of the radial stacker, and each conveyor means being located on the same radial line as the group of discharge gates from which it can receive the second flow.

2. A storage facility according to claim 1 wherein the storage space includes internal containment walls providing a plurality of separate subspaces, each subspace including at least one roof access aperture and at least one floor discharge gate.

3. A storage facility according to claim 2 wherein at least one internal containment wall is located radially relative to the inner and outer arcuate walls.

4. A storage facility according to claim 2 wherein at least one internal containment wall is located to be arcuate and concentric with the inner and outer walls.

5. A storage facility according to claim 4 wherein the arcuate containment wall is located on the same arc as the access apertures, and the or each access aperture above the arcuate containment wall is constructed and arranged to deliver the first flow into either of the subspaces adjacent the arcuate containment wall.

6. A storage facility according to claim 2 wherein at least one of the internal containment walls is located radially relative to the inner and outer arcuate walls, and at least one of the internal containment walls is located to be arcuate and concentric with the inner and outer walls.

7. A storage facility according to claim 2 wherein each subspace includes a plurality of discharge gates, and the second control means is constructed and arranged to open each gate selectively.

8. A storage facility according to claim 1 wherein the radial stacker means includes a belt conveyor system supported by a support tower and by the inner arcuate wall.

9. A storage facility according to claim 1 wherein the arc length of the arcuate structure is at least 180°.

* * * * *